US007806515B2

(12) United States Patent
Harvey et al.

(10) Patent No.: US 7,806,515 B2
(45) Date of Patent: Oct. 5, 2010

(54) DROPLET DEPOSITION APPARATUS

(75) Inventors: Robert A. Harvey, Cambridge (GB); Howard J. Manning, Edinburgh (GB)

(73) Assignee: XAAR Technology Limited, Cambridgeshire (GB)

( * ) Notice: Subject to any disclaimer, the term of this patent is extended or adjusted under 35 U.S.C. 154(b) by 758 days.

(21) Appl. No.: 10/565,063

(22) PCT Filed: Jul. 16, 2004

(86) PCT No.: PCT/GB2004/003116

§ 371 (c)(1),
(2), (4) Date: Apr. 9, 2007

(87) PCT Pub. No.: WO2005/007415

PCT Pub. Date: Jan. 27, 2005

(65) Prior Publication Data

US 2007/0188564 A1 Aug. 16, 2007

(30) Foreign Application Priority Data

Jul. 16, 2003 (GB) ..... 0316584.2

(51) Int. Cl.
*B41J 2/05* (2006.01)
*B41J 2/175* (2006.01)
*B41J 2/18* (2006.01)

(52) U.S. Cl. ..... 347/65; 347/85; 347/89

(58) Field of Classification Search ..... 347/84, 347/85, 94, 65, 89
See application file for complete search history.

(56) References Cited

U.S. PATENT DOCUMENTS 5,087,931 A 2/1992 Rawson
5,561,448 A 10/1996 Kaneko et al. ..... 347/29
5,818,485 A 10/1998 Rezanka ..... 347/89
6,152,559 A 11/2000 Kojima ..... 347/89
7,128,406 B2 10/2006 Dixon et al.
2002/0180827 A1 * 12/2002 Hirota ..... 347/20
2003/0058307 A1 3/2003 Eguchi et al. ..... 347/62

FOREIGN PATENT DOCUMENTS

EP 737 580 A2 10/1996
EP 924 077 A2 6/1999
EP 965 452 A1 12/1999
JP 4-229280 8/1992

(Continued)

OTHER PUBLICATIONS

International Search Report in PCT/GB2004/003116 dated Feb. 14, 2005.

*Primary Examiner*—Stephen D Meier
*Assistant Examiner*—Geoffrey Mruk
(74) *Attorney, Agent, or Firm*—Marshall, Gerstein & Borun LLP

(57) ABSTRACT

Inkjet printhead with an array of ejection chambers spaced in an array direction, each communicating with an ink orifice, inlet and outlet plenum chambers communicating with the ejection chambers, and inlet and outlet manifolds extending in the array direction and communicating with the plenum chambers through a porous sheet. While there are substantial net ink flows in the array direction in the inlet and the outlet manifolds, there is substantially no net flow in the array direction in the inlet or outlet plenum chamber. Ink pressure is therefore constant over the array of ejection chambers.

8 Claims, 12 Drawing Sheets

FOREIGN PATENT DOCUMENTS

| | | | |
|---|---|---|---|
| JP | 4-347647 | | 12/1992 |
| JP | 9-277552 | | 10/1997 |
| JP | 11-342634 | | 12/1999 |
| JP | 2002-127406 | | 5/2002 |
| JP | 2002144576 | | 5/2002 |
| JP | 2002-533247 | | 10/2002 |
| WO | WO 00/38928 | * | 7/2000 |
| WO | WO 03/022586 A2 | | 3/2003 |

* cited by examiner

Figure 1 – Prior Art

Figure 2 – Prior Art

DROPLET DEPOSITION APPARATUS

BACKGROUND OF THE INVENTION

1. Field of the Invention
2. Related Technology

The present invention relates to droplet deposition apparatus and in particular to ink jet printers Ink jet printers are no longer viewed simply as office printers, their versatility means that they are now used in digital presses and other industrial markets. It is not uncommon for print heads to contain in excess of 500 nozzles and it is anticipated that "page wide" print heads containing over 2000 nozzles will be commercially available in the near future.

It has been found that circulating ink through the print head when printing and when not printing has a beneficial affect on the droplet characteristics since the temperature may be controlled by a heat exchanger positioned outside the head.

A further improvement taught in W000/38928 is to continually pass ink through the ejection chambers. This improves the reliability of the print head by, at high enough flow-rates, reducing the possibility of air or dirt lodging in the nozzle and continually supplying fresh ink to the ejection chambers.

Because of the size of these large "page wide" print heads a large amount of ink is ejected from the heads when printing full black, i.e. when all the ejection chambers are printing at their maximum rate. It is proposed in print heads of the prior art that a flow rate of around ten times the maximum printing rate is used in order to help flush dirt out of the print head and maintain the head at a constant temperature.

Each nozzle should be at a similar pressure, preferably just below atmospheric, to minimise variations in ejection characteristics along the length of the print head.

Ink is supplied to the ejection chambers from elongate inlet and outlet manifolds that extend the length of the array and the pressure drop along the manifolds is a function of the circulation rate, manifold size and ink characteristics.

To maintain a constant pressure at each nozzle it is necessary, in view of the large flow of ink through the head, to provide inlet and outlet manifolds having large hydraulic diameters.

Print heads typically have nozzles arranged in linear arrays and are often grouped together in a printing machine such that the linear arrays of each print head lie parallel. In this arrangement multicolour printing is possible from a single pass of the paper under the print heads. A variation in the movement of the paper has one of the largest effects on drop landing position of droplets ejected from a print head possibly giving rise to visible defects in the printed image.

The effects of the variation in substrate movement can be reduced by locating the print heads close together. However, the large hydraulic diameters of the inlet and outlet manifolds often preclude this.

Ink is an expensive commodity and where the ink is a high value fluid such as, for example, biological fluid or fluid used to manufacture electronic component, the volume of ejection fluid contained within the large manifold may be prohibitive to the economic validity of the print head.

GENERAL DESCRIPTION OF THE INVENTION

It is an object of certain embodiments of the present invention to seek to provide smaller and more compact manifolds.

The large manifolds hold a large volume of ink that prohibits the use of a print head on a scanning carriage as movement of the head initiates "sloshing" of the ink in the manifolds. The high volume of ink also adds to the mass of the print head and consequentially the cost of the scanning carriage.

It is accordingly an object of certain embodiments of the present invention to seek to provide manifolds for use on a scanning or movable carriage According to one aspect of the present invention there is provided droplet deposition apparatus comprising an inlet manifold, an outlet manifold and a fluid chamber in communication with at least one droplet deposition orifice, said fluid chamber being separated from at least one of said manifolds by a porous element and there being in use of the apparatus a flow of fluid between said inlet manifold and said outlet manifold through said chamber, wherein the pressure drop across the porous element is the dominant pressure drop in said flow.

Preferably, said fluid chamber is separated from said inlet manifold by a porous element and is separated from said outlet manifold by the same or a different porous element.

Advantageously, a plurality of orifices arranged as an elongate array, communicate with said fluid chamber, and either or both of said inlet and outlet manifolds extend parallel to said elongate array.

Suitably, there is an array of ejection chambers within said fluid chamber, each ejection chamber communicating with a respective orifice. In one embodiment, said fluid chamber is divided into an inlet chamber and an outlet chamber by said array of ejection chambers, there being a flow of fluid between said inlet and said outlet chamber in parallel through said ejection chambers.

In another aspect, the present invention consists in droplet deposition apparatus comprising an array of ejection chambers spaced in an array direction, each communicating with a droplet ejection orifice; at least one plenum chamber extending in the array direction and communicating with each of the ejection chambers; and an inlet manifold extending in the array direction and communicating with the plenum chamber through an element providing a resistance to a fluid; there being, in use, a flow of fluid from the inlet manifold through the plenum chamber to the ejection chambers, there being a substantial net flow in the array direction in the inlet manifold, and substantially no net flow in the array direction in the plenum chamber.

In yet a further aspect, the present invention consists in a method of supplying a fluid to an orifice of a droplet deposition apparatus having a line of orifices and an ink supply manifold extending parallel to said line of orifices, said method comprising the steps of: supplying ink in said manifold flowing substantially parallel to said line of orifices and in a volume in excess of that which may be ejected from the orifices, and causing said ink to flow through at least one restrictive element and into a plenum chamber wherein the flow of fluid within said plenum chamber is substantially orthogonal to said line of orifices.

Preferably, the pressure of the fluid in the plenum chamber is controlled via a port opening into said plenum chamber.

In still a further aspect, the present invention consists in printing apparatus comprising a printhead which is scanned in use, the printhead comprising array of ejection chambers spaced in an array direction, each communicating with an ink orifice; an inlet plenum chamber communicating with each of the ejection chambers; an inlet manifold extending in the array direction and communicating with the inlet plenum chamber through a porous element; an outlet plenum chamber communicating with each of the ejection chambers; an outlet manifold extending in the array direction and communicating with the outlet plenum chamber through the same or a different porous element there being, in use, a flow of fluid through each ejection chambers, there being a substantial net flow in the array direction in the inlet and the outlet manifold, and substantially no net flow in the array direction in the inlet or outlet plenum chamber.

Suitably, pressure control means communicate with the plenum chambers for controlling the pressure at said orifice, the pressure control means preferably comprising a pair of fluid resistances connected in series with the mid point of said resistances being connected with a controllable pressure source.

In one form of the present invention there is provided a droplet deposition apparatus comprising: a fluid chamber communicating with an orifice for droplet ejection, means for controlling the pressure of the fluid in said chamber, an inlet manifold and an outlet manifold each having a pressure drop along their length, a supply means for allowing passage of fluid to said chamber from said inlet manifold, a removal means for allowing passage of fluid from said chamber to said outlet manifold, wherein the pressure drop across said supply means or said removal means is greater than the total pressure drop along the length of said inlet manifold or said outlet manifold.

Actuators capable of ejecting a droplet from the orifice or nozzle may be located it directly in the fluid chamber. Alternatively, a row of ejection chambers comprising the actuators may be provided in communication between the fluid chamber and the orifice. In a preferred embodiment the ejection chambers divide the fluid chamber into two separate chambers: the inlet plenum chamber and the outlet plenum chamber. The inlet plenum chamber is positioned upstream of the ejection chambers and between the supply means and the ejection chambers. The outlet plenum chamber is positioned downstream of the ejection chambers and between the removal means and the ejection chambers. There is provided fluid communication between the inlet plenum chamber and the outlet plenum chamber through the ejection chambers.

The actuators may be, for example electromechanical, in that applying an electric field causes deformation of a portion of the actuator, magnetic in that applying a magnetic field causes deformation of a portion of the actuator, thermal in that applying energy to the fluid produces a bubble, or any other appropriate form.

Active or non-active walls depending on the architecture may define the ejection chambers.

The means for controlling the pressure in the chamber may be indirect in that the head of pressure supplied to the inlet manifold is varied. These means, for example, may be an external pump.

In a preferred embodiment the means for controlling the pressure in the chamber are direct in that a tube or port open to a pressure source, vacuum source or to atmosphere connects directly with the chamber. Other means such as a diaphragm forming part of the chamber are possible. Means that vary the pressure drop across the supply means or removal means may also be used to control the pressure in the chamber. In a particularly preferred embodiment, the means for controlling the pressure in the pressure chamber comprise a Wheatstone bridge pressure control as described in WO 03/022586 and incorporated herein by reference.

This form of pressure control is of particular use where the fluid chamber is divided into an inlet plenum chamber and an outlet plenum chamber by ejection chambers located between the two with an orifice positioned within the ejection chamber.

The Wheatstone bridge comprises four arms having a resistance to the fluid, the four arms are: a) the ejection chamber between the inlet plenum chamber and the orifice, b) the ejection chamber between the orifice and outlet plenum chamber, c) a passageway provided between the outlet plenum chamber and an external pressure reference point and d) a passageway provided between the external pressure reference point and the inlet plenum chamber.

There may be a flow of fluid around the arm of the Wheatstone bridge that comprises the pressure reference point that is of the order 1 times the total flowrate of ink ejected through the orifices. Other values, greater or lower, may be appropriate. In some circumstances there may be a zero flow-rate around this point.

The supply means may form one wall of the chamber, may be located within the chamber or may be located remote from the chamber in, or part of an ancillary chamber. The supply means preferably supply ink along the length of the chamber and the ink exiting the supply means is preferably at the same pressure along the length of the supply means. This beneficially provides a constant pressure along the length of the chamber.

The flowrate fluid is supplied to the chamber through the supply means is preferably greater than the flowrate at which fluid can be ejected through the orifices. Preferably this rate is of the order 10 times the maximum ejection rate though other rates greater and less than this figure will be appropriate depending on, for example, the amount of dirt or air in the ink or, where the ink is used to cool a drive circuit, the amount of heat dissipated by the drive circuit.

The supply means are preferably formed of a material or a structure that provides a high pressure drop whilst allowing fluid to pass between the inlet manifold and the chamber. In one embodiment the material may be one that is porous for example, but not limited to, a sintered ceramic or metal, woven or meshed fibre or etched, cut or electroformed structures such as chemically etched foil. Preferably the pore sizes will be of a sufficient size such that a filtering function is provided to the fluid. The pore sizes will preferably be below 50 μm and more preferably below 25 μm.

In a preferred embodiment the pressure drop across the supply means varies along its length. This may be achieved by, for example, varying the pore size or cross-sectional area of the supply means.

In a further embodiment the pressure drop is provided by a structure formed by, for example, laminated plates that provides narrow channels. The cross-sectional area of the channels may be modified during operation by, for example, heating or cooling the area around the channel or by depositing within the channel a material that varies its volume of shape under application of a magnetic field. A piezoelectric ceramic is an example of a suitable material.

The pressure of fluid in the supply manifold is greater than the pressure of the fluid in the fluid chamber, there being a significant pressure drop across the supply means. The pressure drop across the supply means is greater than the total pressure drop along the length of the manifold and preferably significantly greater.

The removal means are preferably formed of a material or a structure that provides a high pressure drop whilst allowing fluid to pass between the chamber and the outlet manifold. Examples of suitable material include those suggested for the supply means and suitably, the same material can be used for both. Since the pore sizes need not provide a filtering function, the pore sizes may be larger than that of the supply means. Preferably, where pore sizes differ between the supply and the removal, the numbers of pores are adjusted to maintain the flow resistances equal.

In a preferred embodiment the pressure drop across the removal means varies along its length. This may be achieved by, for example, varying the pore size or cross-sectional area of the supply means.

In a further embodiment the pressure drop is provided by a structure formed by, for example, laminated plates that provides narrow channels. The cross-sectional area of the channels may be modified during operation by, for example, heating or cooling the area around the channel or by depositing within the channel a material that varies its volume of shape under application of a magnetic field. A piezoelectric ceramic is an example of a suitable material.

The removal means and supply means are preferably formed of the same material and, in one embodiment may be a single component; a portion or portions of the component providing the supply function and a portion or portions of the component providing the remove function. In an alternative embodiment they are two separate components.

The pressure of fluid in the outlet manifold is lower than the pressure of the fluid in the fluid chamber, there being a significant pressure drop across the removal means. The pressure drop across the removal means is greater than the pressure drop along the length of the manifold and preferably significantly greater.

The pressure drop across the supply means and 1 or the removal means is preferably greater than the pressure drop across the fluid chamber and preferably significantly greater.

The inlet or outlet manifolds may, where the supply means and/or removal means are tubular, be the bores within the tubes. Alternately, they may be chambers isolated from the fluid chamber by the supply and removal means.

The inlet manifold is preferably supplied with fluid from an external circuit. For example, a pump or other means such as gravity may be used to provide the required head of pressure in the ink supply manifold.

According to a second aspect of the present invention there is provided a droplet deposition apparatus comprising an inlet manifold, an outlet manifold and a fluid chamber in communication with at least one orifice; said fluid chamber separated from said inlet manifold and said outlet manifold by at least one element providing a resistance to a fluid and allowing said fluid to pass therethrough; there being a flow of said fluid between said inlet manifold and said outlet manifold through said chamber, and pressure control means communicating directly with said fluid chamber for controlling the pressure at said orifice.

The print head may be mounted on a scanning carriage.

According to a third aspect there is provided a droplet deposition apparatus comprising: a print head comprising an inlet manifold, an outlet manifold and a fluid chamber in communication with at least one orifice Said fluid chamber separated from said inlet manifold and said outlet manifold by at least one element providing a resistance to a fluid and allowing said fluid to pass therethrough; and there being a flow of fluid between said inlet manifold and said outlet manifold through said chamber, Wherein the pressure drop across the said at least one element is the dominant pressure drop in the print head.

Said apparatus further comprising pressure control means communicating directly with said fluid chamber for controlling the pressure at said orifice, The inlet manifold, porous barrier, fluid chamber and ejection chambers may be formed from a single etched sheet.

According to a fourth aspect of the present invention there is provided a droplet deposition apparatus comprising a chamber in communication with an ejection nozzle, with supply means extending the substantially the length of the chamber for supplying fluid to said chamber uniformly along substantially its length, said chamber further comprising removal means extending substantially along its length for removing fluid from said chamber along substantially its length, wherein a body of circulating fluid passes through said chamber between said supply means and said removal means.

The supply means and removal means may be formed of a high pressure drop filter material or sintered plate which forms one wall of the chamber.

The supply means and removal means may be located in an antechamber remote from said chamber.

Any one of the pressure control means described above may be provided in communication with the chamber thereby controlling the pressure.

The invention described herein also resides in methods.

According to a fifth aspect there is provided a method of supplying a fluid to an orifice of a droplet deposition apparatus having a line of orifices and an ink supply manifold extending parallel to said orifices, said method comprising the steps of: supplying ink in said manifold said ink flowing substantially parallel to said line of orifices and in a volume in excess of that which may be ejected from the orifices, and causing said ink to flow through at least one restrictive element and into a fluid chamber wherein the flow of fluid within said fluid chamber is substantially not parallel to said line of orifices.

The term porous as used in this specification is not intended to be restricted to material, which is of its nature porous, but is intended to include material in which pores are cut or formed. The number of pores in porous material as used in embodiments of this invention will be very much larger (at least one and typically several orders of magnitude greater) than the number of ejection chambers receiving fluid through the porous material.

BRIEF DESCRIPTION OF THE DRAWINGS

The invention will now be described, by way of example only, with reference to the following drawings in which.

DETAILED DESCRIPTION

Figure 1:
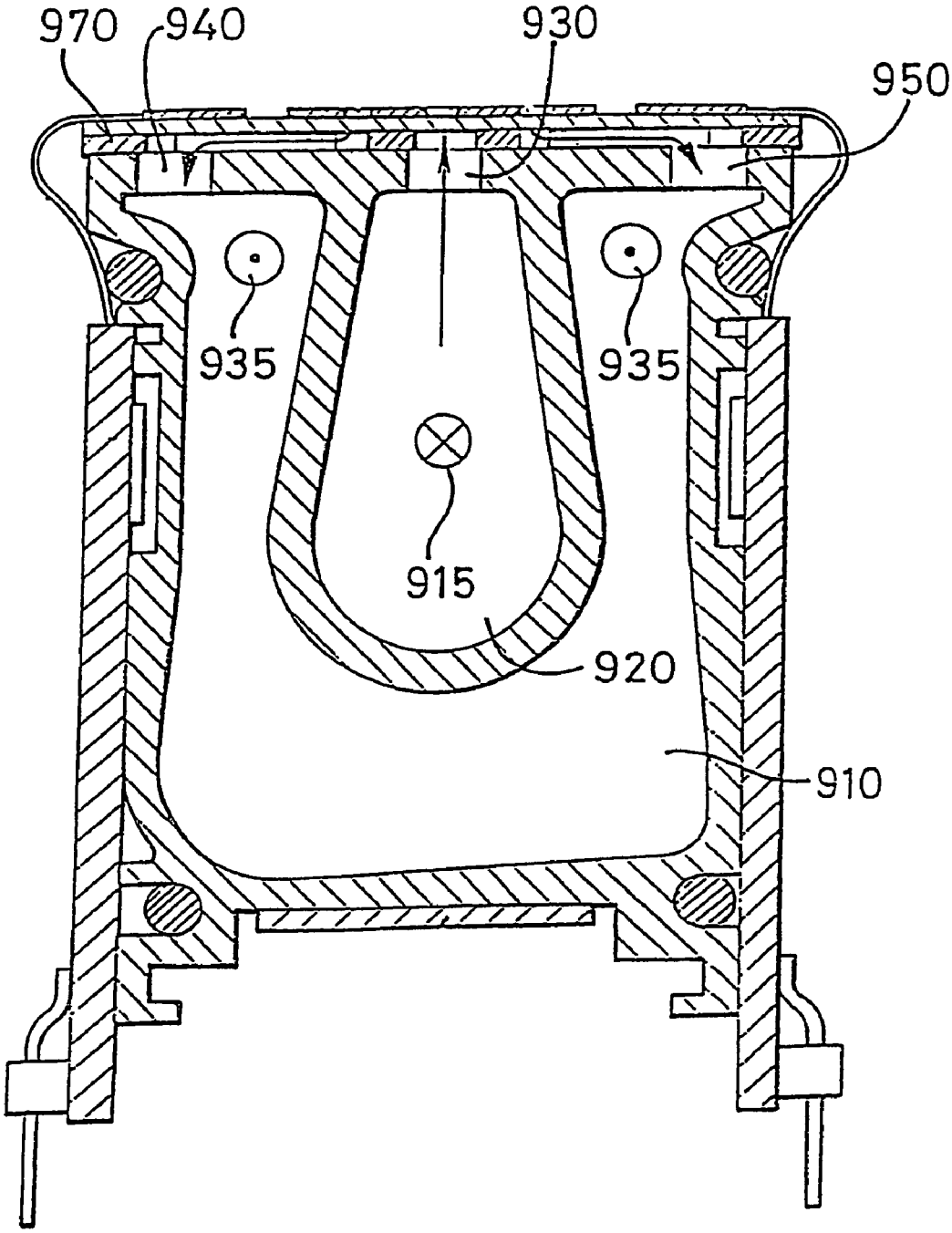
FIG. 1 shows an ink supply manifold according to the prior art.

FIG. 1 depicts an ink supply support of an inkjet printer according to the prior art. The figure is a cross-section through a manifold structure that, in addition to controlling the flows of ink, provides support at its top surface for the piezoelectric elements that are actuable to eject ink through nozzles not shown in this figure. The piezoelectric elements are later described with reference to FIG. 2.

In FIG. 1, a central inlet manifold 920 has ink flowing in one direction (depicted as 915) along the length of the array. Conduits 930 formed in the top of the array and in a base plate 970 allow the ink to reach the pressure chambers (not shown) Ink is ejected through nozzles and the un-ejected ink is circulated to the outlet manifold 910 via two ports 940 and 950. Ink in the outlet manifold flows in the opposite direction 935 in order to minimise any thermal gradient over the length of the print head.

A positive pressure relative to atmospheric is established at the entrance to the inlet manifold by a pump and a negative pressure relative to atmospheric is established at the exit of the outlet manifold.

As in any hydraulic system there are pressure gradients and pressure drops such as along the manifolds, through the holes 930, 940 and 950 in the supply support and the ports provided in base plate 970.

The manifolds within the print head need to be large as the inlet carries (typically) ten times the maximum printing flow rate, while the outlet manifold carries between nine and ten times the maximum printing flow rate. Uniformity of the pressure at the nozzles is maintained by ensuring the pressure difference between the entrance of the inlet manifold and exit of the outlet manifold is dominated by the ejection chambers.

It is therefore necessary that the manifolds 920, 910 and the ports 930, 940 and 950 are large to minimise both the pressure drop through the ports 930, 940 and 950 and along the inlet and outlet manifolds.

Figure 2:
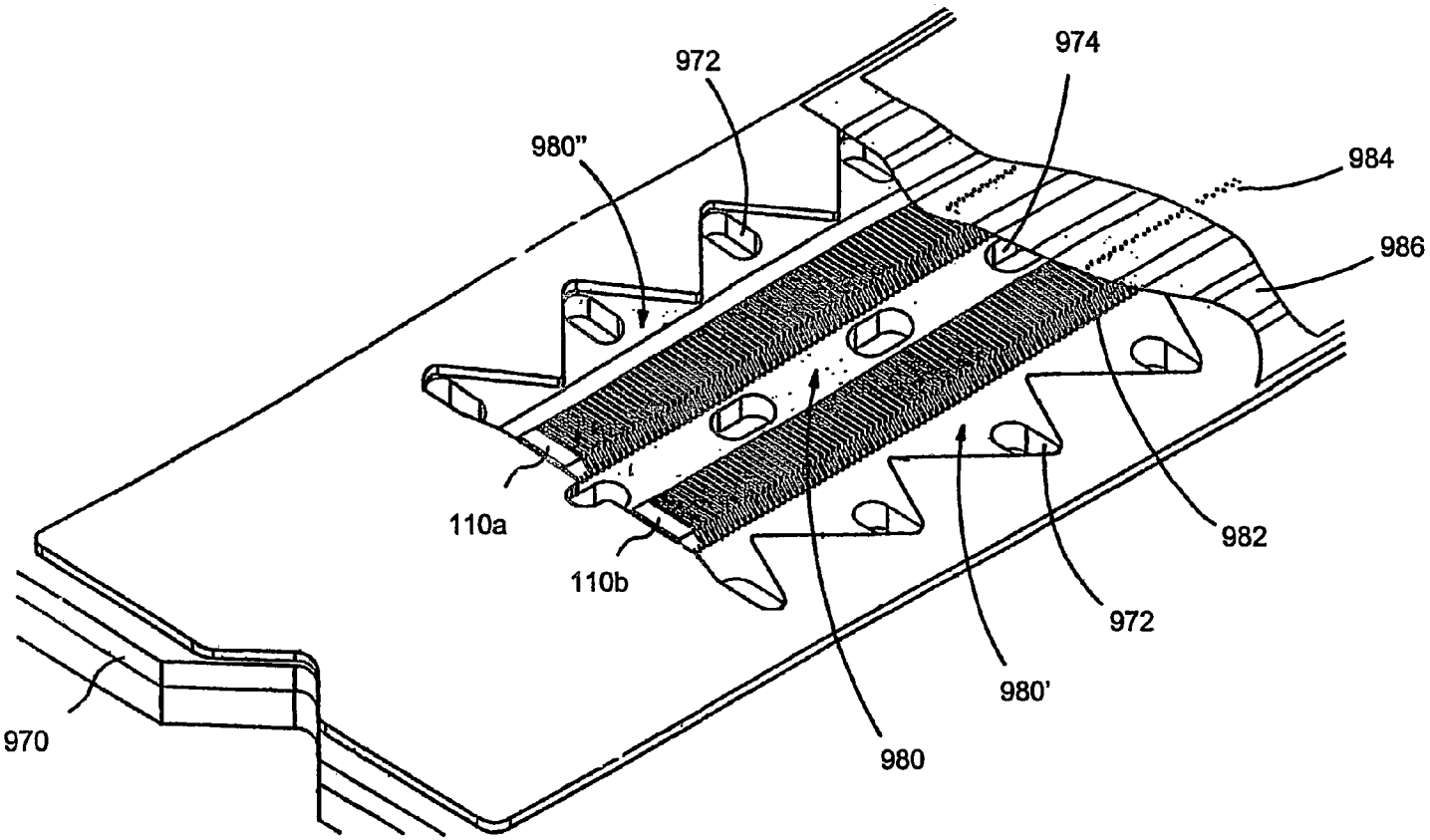
FIG. 2 depicts a through flow ink jet printhead according to the prior art.

FIG. 2 depicts the structure of the actuators and flow path in greater detail. Ports 974 provided in the base plate 970 to supply ink to a fluid chamber which is divided into three sections 980, 980' and 980" by the ejection chambers 982 formed in two rows of PZT 110*a*, 110*b*. The outlet ports 972 allow the ink to flow from the plenum chamber back to the supply support.

Channels are sawn in the piezoelectric elements 110*a*, 110*b* to provide the ejection chambers. Electrical connection tracks (not shown) are formed on the substrate 970 and connect chips (not shown) to electrodes (not shown) on either side of the walls bounding channels. The piezoelectric walls are poled such that upon activation of a field between the electrodes formed on either side of the walls, they deflect in shear mode to eject an ink droplet from a nozzle 984 formed on a cover plate 986 bonded to the tops of the walls.

Figure 3:
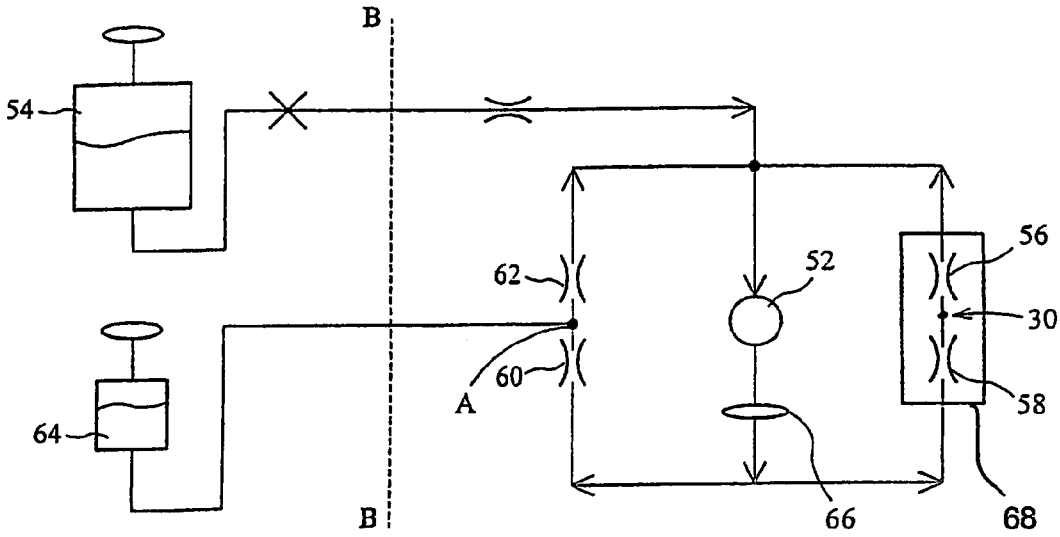
FIG. 3 shows an ink supply circuit according to the prior art.

A particularly elegant ink supply for a print head is depicted in FIG. 3. The arrangement shown in FIG. 3 has a single row of ejection chambers, rather than the two parallel rows of ejection chambers established by the respective piezoelectric elements 110*a*, 110*b* of FIG. 2. The principle of operation remains however the same. A single row print head 68 is schematically depicted as two resistors 58,56 either side of the nozzle 30. The inlet manifold 920, ports 974 and one half of an ejection chamber of FIG. 2 constitute the resistor 58 upstream of the nozzle. The outlet manifold 910, ports 972 and one half of the ejection chamber of FIG. 2 constitute the resistor 56 downstream of the nozzle. If the nozzle was not located midway along the ejection chambers then the contribution the ejection chamber constitutes to the value of the resistors 56 and 58 would vary. Suitably, the fluid resistances depicted by resistors 56 and 58 are substantially identical.

A pump 52 supplies both the print head 68 and a pressure reference arm in an arrangement analogous to an electrical Wheatstone bridge circuit. A filter 66 provides a cleaning function for the ink. The resistor 60 and the resistor 62 are matched to resistor 58 and 56 respectively and preferably all four resistors are. The pressure at the nozzle can be controlled by raising or lowering the height of a small reservoir 64 that communicates with the pressure reference point "A". The flow of ink through the print head is greater than the flow of ink through the reference arm. The reservoir 54 provides fluid to the circuit to make up that lost through evaporation or from the nozzles by ejection.

Whilst the prior art printhead arrangement shown in FIGS. 1, 2 and 3 has many useful features, it does involve the use of large volumes of ink in the manifolds.

Embodiments will now be described of the present invention in which useful features of the prior arrangement are maintained, but in which the need for large manifold volumes is removed.

Figure 4A:
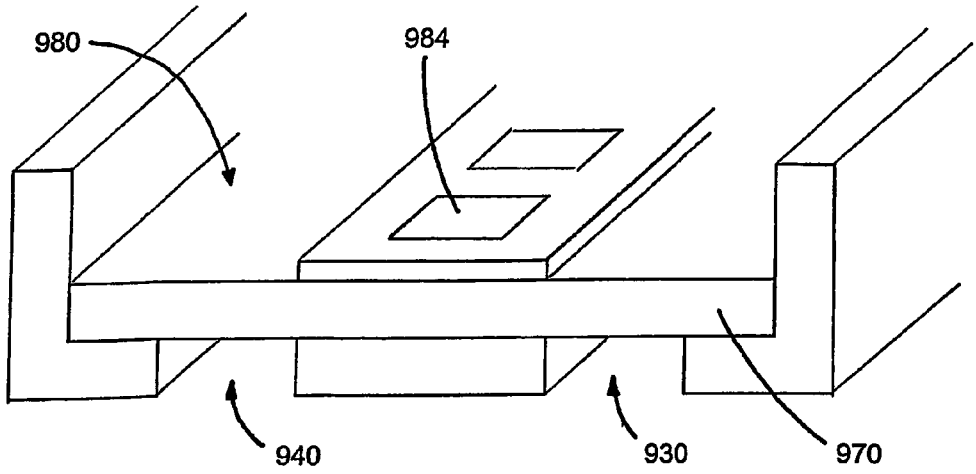
FIGS. 4A and 4B show an ink supply according to one embodiment of the present invention.
Figure 4B:
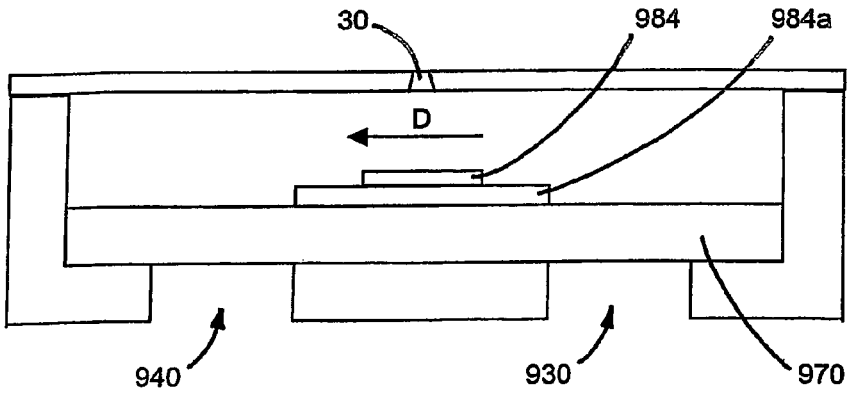

FIGS. 4A and 4B depict one embodiment of the present invention in schematic form, FIG. 4A being a perspective and FIG. 4B a sectional view.

A base plate 970 is provided of a porous, sintered ceramic.

The fluid chamber 980 contains actuators 984 mounted to a common support 984*a* located on the base plate 970. The support 984*a* may carry all the necessary electrical connectors. An actuator in this arrangement is not separated from an adjacent actuator by walls. The flow of ink across the actuators is still substantially in the direction of the arrow D. Each actuator has a corresponding nozzle 30.

The pressure drop across the porous plate 970 is arranged to be significantly greater than the pressure drop along the length of each manifold (the length in this context being the direction out of the paper in FIG. 4. A thereby maintaining a substantially constant pressure along the length of the fluid chamber inlet 980 despite any pressure drop along the length of the inlet manifold 930.

Preferably, the pores in the plate 970 vary in size and/or distribution along the length of the inlet and/or outlet manifold such that the resistance of the porous plate decreases to compensate for the increase in viscous and other flow resistance along the manifold in the direction away from the inlet or outlet, respectively of the manifold. In this way there can be maintained a precisely constant pressure along the length of the fluid chamber inlet 980 despite any pressure drop along the length of the inlet manifold 930.

Beneficially, this allows the size of the manifold 930 to be reduced, as it is no longer necessary to maintain a constant pressure along its length and even large pressure differences along the length can be equalized by making the pressure drop across the porous support 970 high in comparison with the pressure drop along the length of the manifold.

In this embodiment, by providing an inlet and outlet manifold separated from a plenum chamber by the porous support, the flow of ink along the manifolds is converted to a flow across the chamber perpendicular to the length of the manifold.

In the architecture of FIG. 4, actuators are provided atop the support 970. The actuators can take the form of heaters that provide thermal energy to the fluid and thereby cause fluid to be ejected through the nozzle. The parallel flow of fluid within the plenum chamber provides a pressure at each of the actuators, when quiescent, which is the same.

Figure 5A:
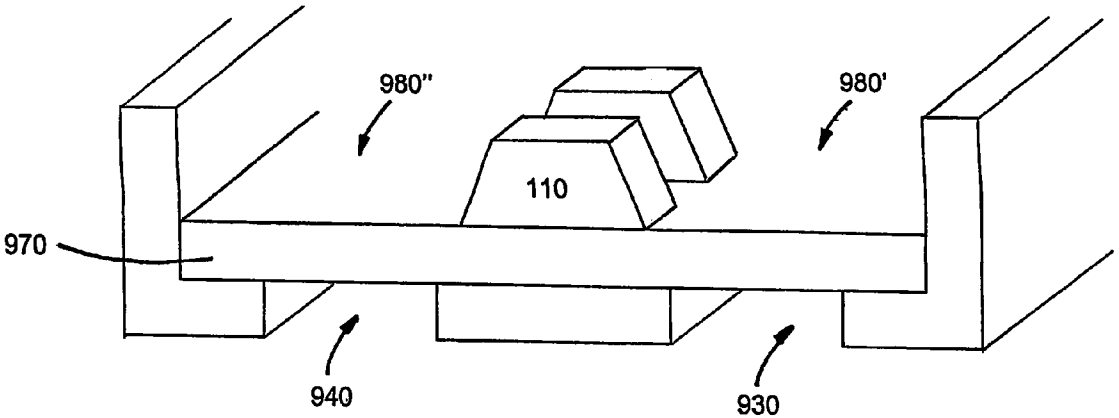
FIGS. 5A and 5B show variations of an ink supply according to a second embodiment of the present invention.

As depicted in FIG. 5A, the fluid chamber 980 may, however be divided into two or more separate chambers, the inlet plenum chamber 980' and the outlet plenum chamber 980" which are in fluid connection via the ejection chambers 990. These ejection chambers are positioned within the fluid chamber between the inlet and outlet manifolds 930, 940.

Blocks of PZT 110 have ejection channels sawn perpendicular to the length of the manifold to define the respective ejection chambers 990, and parallel to the flow of ink in the chamber. Fluid circulates continuously through the channels providing a cleaning and cooling function. The walls are polarised orthogonal to the elongation of the ejection channels and electrodes provided on either side of the wall allow an electric field to pass across the wall. The field passed across the walls causes the walls to deflect into or out of the channels thereby causing a droplet of ink to be ejected.

Figure 5B:
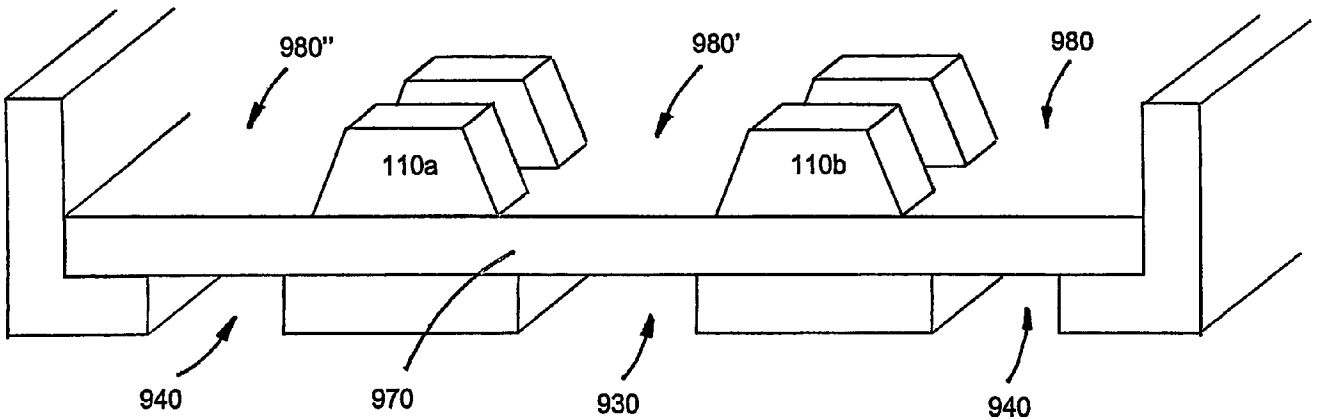

FIG. 5B illustrates a variation in which (as in the arrangement of FIG. 2), two sawn blocks of PZT 110*a* and 110*b* provide separate, back-to-back arrays of ejection chambers, supplied from a common inlet manifold and common inlet plenum chamber.

Figure 6:
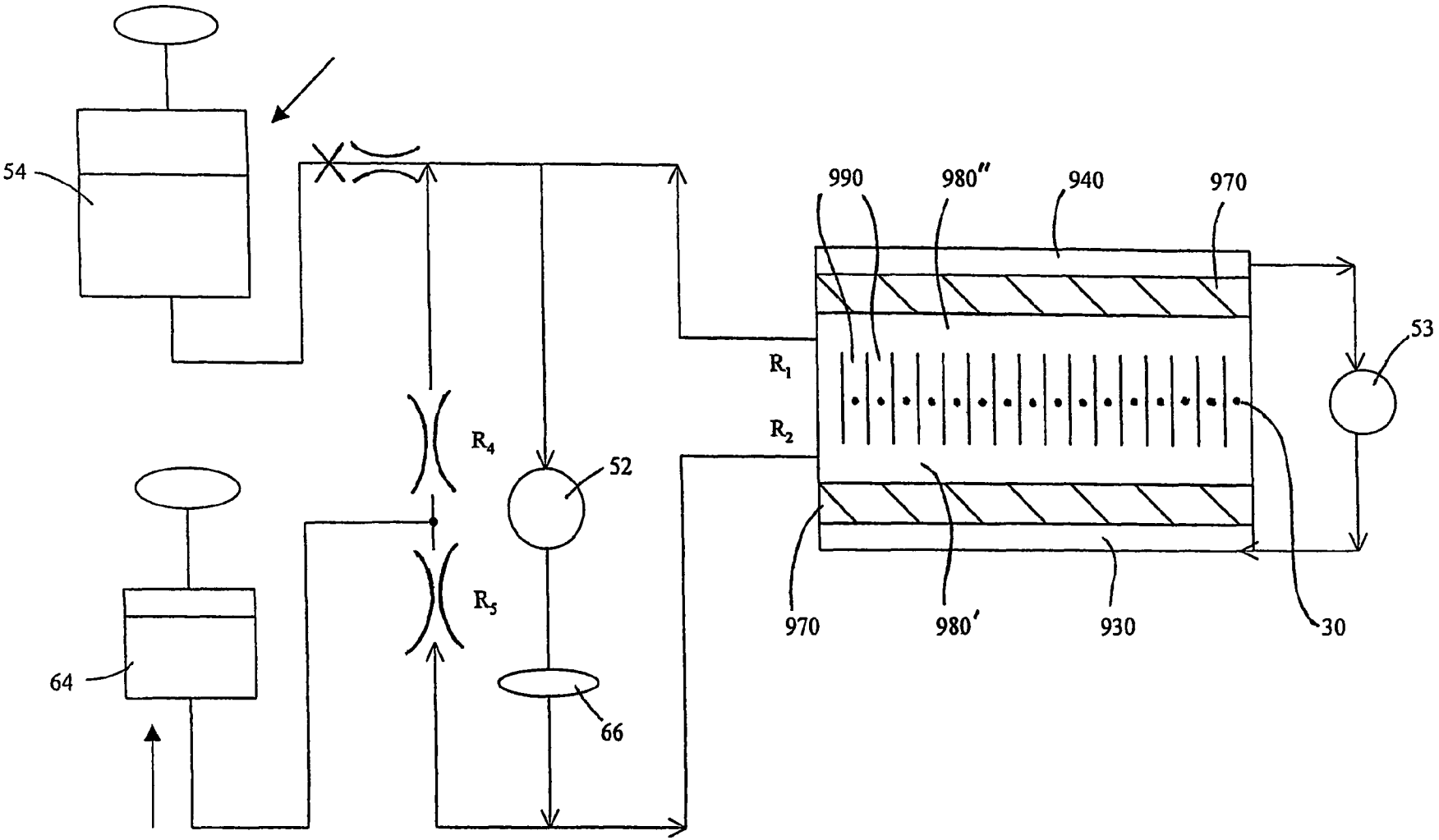
FIG. 6 shows an ink circulation system according to the present invention for supplying ink to a print head.

In both of the embodiments of FIG. 4 and FIG. 5, and any embodiment where the fluid flows past the nozzle, the pressure at the nozzle may be controlled using an improved "Wheatstone Bridge" ink supply based on the example given in FIG. 3. The improved ink supply according to the present invention is described with reference to FIG. 6.

The ejection channels 990 are depicted as a resistor having a resistance R2 upstream of the nozzle and a resistance R1 downstream of the nozzle. Resistors R3 and R4 in a pressure reference arm of the ink supply balance these resistances.

A flow of ink is provided around a second circuit that consists of the print head and the inlet 930 and outlet 940 manifolds. A second pump 53 is provided that pumps ink around this circuit. Where possible, all other reference numerals are identical with FIG. 3.

The pressures and flowrates within the system can be depicted as follows: the pressures Pi(x) along the length of the inlet manifold 930, Pf(x) in the inlet plenum chamber 980', Pn(x) at the nozzles 30, Pr(x) in the outlet plenum chamber 980", Po(x) within the outlet manifold 940, volume flowrates Vi(x) in the inlet manifold, Vf(x) in the inlet plenum chamber, Vr(x) in the outlet plenum chamber and Vo(x) in the outlet manifold.

The pressures and flow rates are determined by the pressure Pc imposed by the small reservoir 64, the pump flow rate versus pressure characteristics of pumps V1, V2 and hydraulic resistances: s, the resistance through the channels, R through the porous element and the external resistors R4 and R5 taken here to equal Q.

The volume flow rate through a channel v(x) averaged over a reasonable length of the array is assumed in this analysis to be constant in time.

In the described arrangement the porous element is a common component providing both the supply means and removal means function and therefore R is substantially the same for both supply and removal. In certain arrangements, different porous elements will be provided at the supply and removal sides. It will in certain cases be useful for the pore size to be smaller at the supply side than at the removal side, to inhibit entry of foreign particles into the fluid chamber but to promote their removal. The resistances can still be made equal by varying the number of pores in each case. It is of course possible that the resistances for both supply and removal are different.

When the print head is not printing (v=0), the pressure at the nozzles is Pc, determined by the small reservoir and typically slightly negative. When the Print head is printing uniformly, v≠0, the pressure at all the nozzles is lowered by an amount equal to:

$$s.v.[QL/(2s)+1+s/(2LQ)]/[1+s/(LQ)]$$

This figure is independent of R such that the permeability of the porous barrier may be limited during use, through blockages etc. without producing problems, provided the pumps can cope with the additional pressure drop.

The nozzle pressure drop on printing varies with Q as follows: if Q<<s/L, the pressure drop is ½ sv. If Q>>s/L, the pressure drop is vQL/2 and has been found to be excessive. If Q=s/L, the nozzle printing drop is an acceptable sv.

Where Q<<s/L, the flow rate of Vi has to be very large to avoid a negative flow rate in the chamber. The negative flow rate is caused by flow from the second pump circulating through the reference arm.

Where V2 is substantial, around ten times the maximum printing flow rate, the system can withstand a considerable pressure drop along the length of the inlet manifold.

Where Q=s/L, the flow rates in the system are (V1−vL+V2)/2 through the restrictors; (V1+vL+V2)/2 through the channels; V2 in the inlet manifold; (V1+vL−V2)/2 in the inlet plenum chamber and (V1−V2)/2 in the outlet plenum chamber. If V1=V2=I0vL then the desired through flow rate in the channels is achieved but the flow rates into and out of the plenum chambers (other than through the channels) are small. The plenum chambers, and inlet and outlet manifolds may be small without presenting an unwanted pressure drop.

Figure 7:
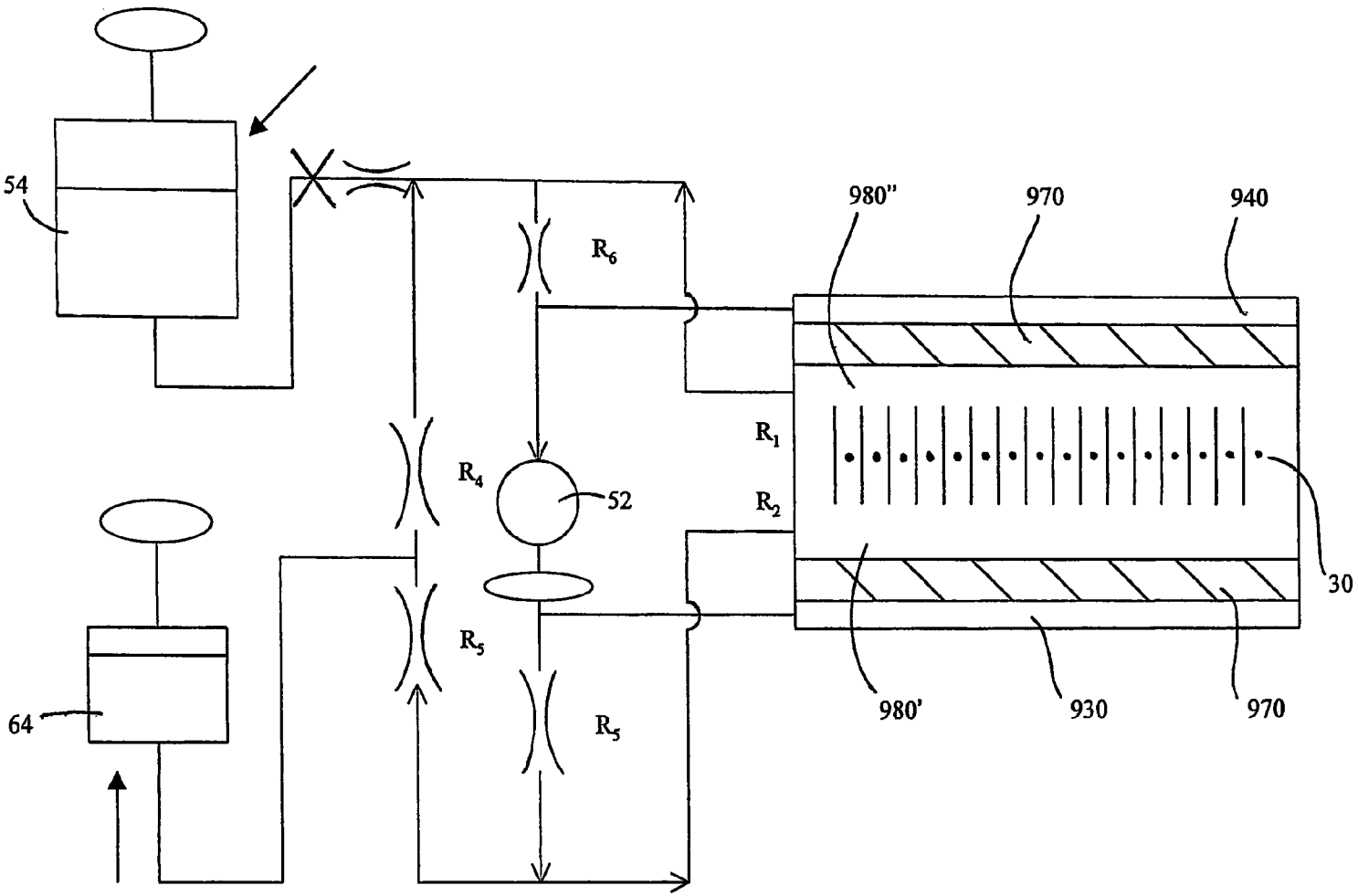
FIG. 7 shows a further ink circulation system according to the present invention for supplying ink to a print head.

In FIG. 7, the dual pumps 52 and 53 are replaced by a single pump 52 where additional resistances R5, R6 are provided which act, with R3 and R4, as a bridge and control the pressures at the nozzles. R5 is of the same order as the resistance of the porous wall 970.

The volume flow rate of the pump 52 is now about twenty times the maximum printing flow rate. Half goes through R5, R3 and then through R4 and R6, the other half through the porous element within the print head. There is very little flow out of or into the fluid chamber and hence no pressure drop along the inside of the fluid chamber.

Because the flow around the pressure reference arm of the Wheatstone bridge is so small, in some circumstances it is possible to replace this structure with a simple connection to a positive or negative pressure source. In certain embodiments this may be achieved by a single outlet from the fluid chamber as opposed to two outlets from the plenum chambers as required by a Wheatstone bridge arrangement.

Figure 8:
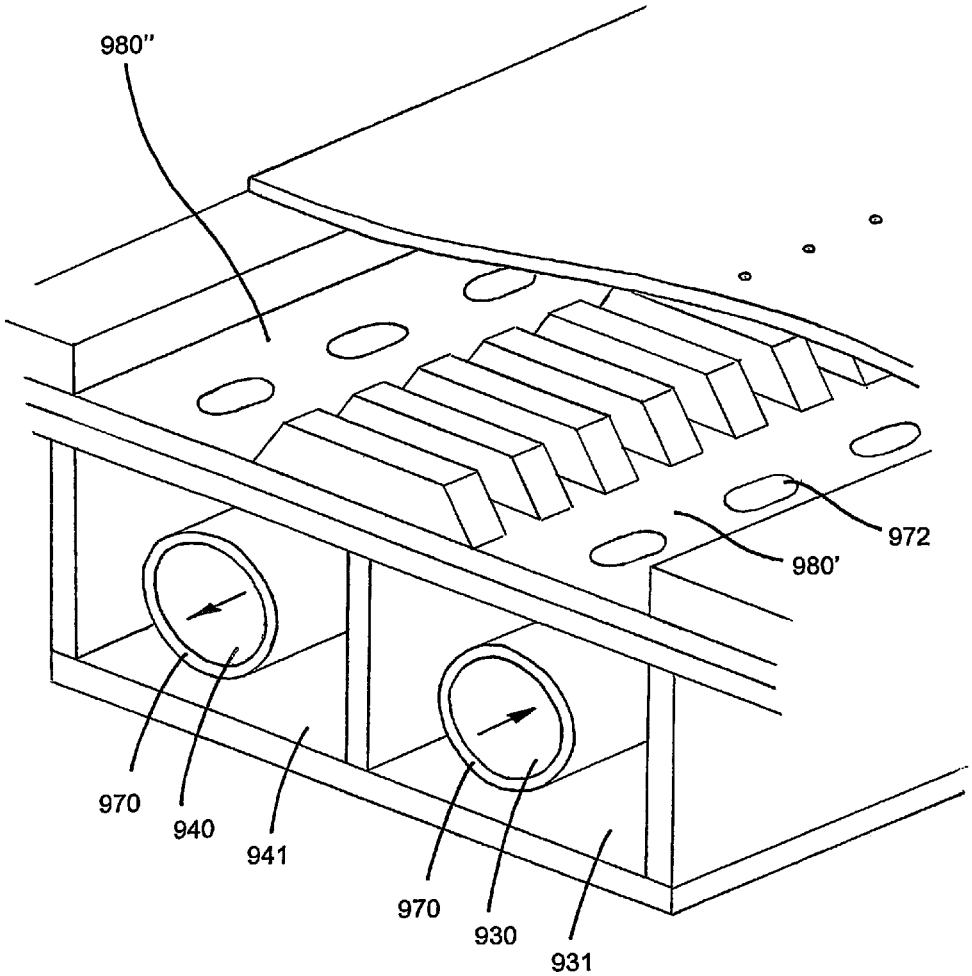
FIG. 8 shows an ink supply manifold according to the present invention.

In a further embodiment, described in FIG. 8, the porous element 970 does not form one wall of the plenum chamber but is positioned in an antechamber 931, 941 which is in communication with the fluid chamber 982 or divided plenum chambers 980' and 980". The porous element is a tube with a bore. The bore forms the inlet manifold 930 and the fluid passes through the element 970 into the inlet antechamber 931. Ports 972 formed in the base plate provide fluid communication between the plenum chamber 980' and the inlet antechamber 931.

The above embodiments all positioned the nozzles and ejection chambers in the fluid chamber and between the ink inlet and the ink outlet. The ability to provide a low pressure drop, small manifolds and ink circulation is, however also useful for print heads commonly known as end-shooters.

Figure 9:
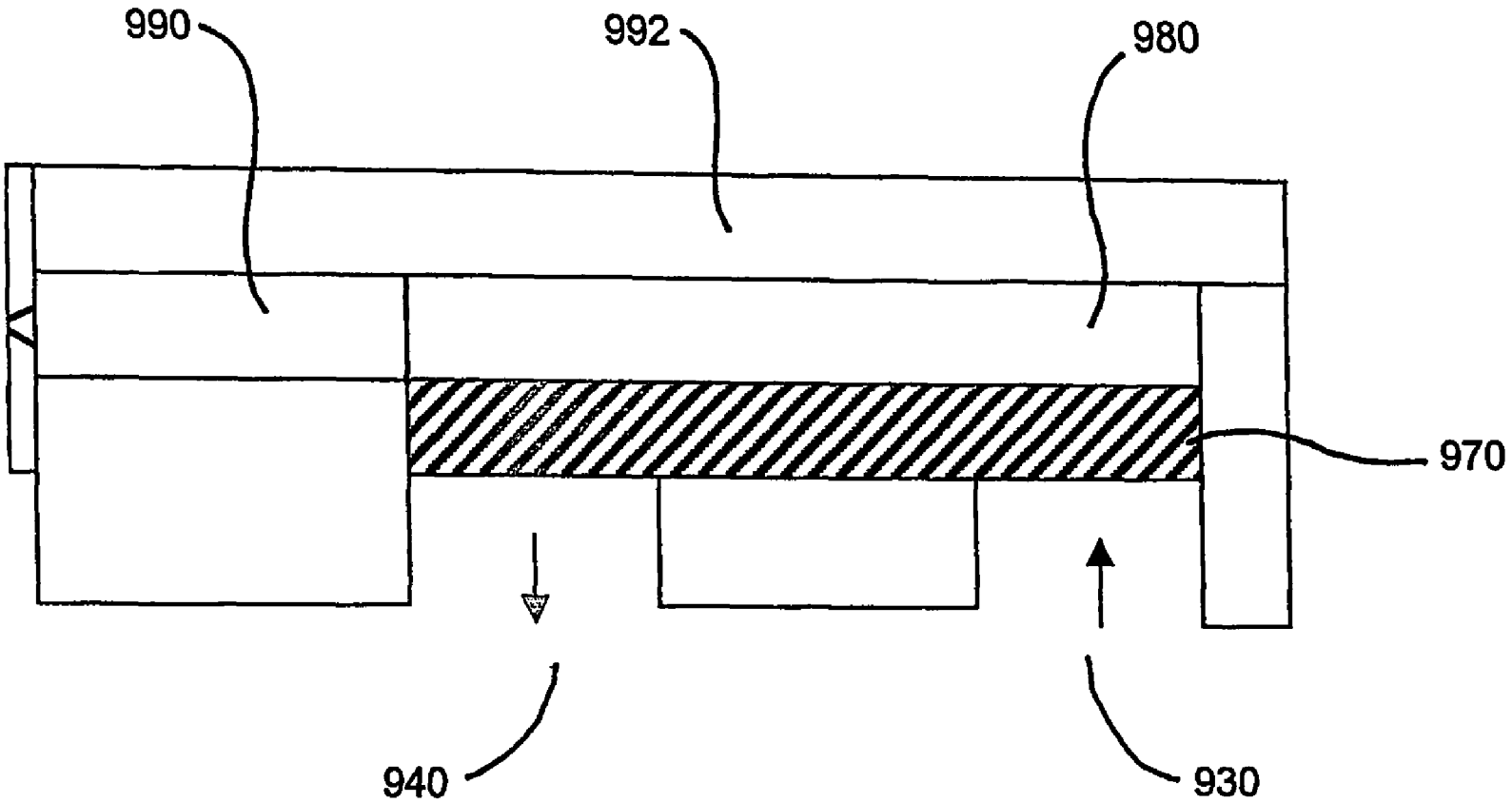
FIG. 9 shows an end shooter print head according to the present invention.

End-shooter print heads do not generally circulate ink but rather have chambers with a single ink inlet and a nozzle positioned in an end wall. FIG. 9 depicts such a structure.

The inlet manifold 930 extends the length of the printhead and supplies ink to the fluid chamber 980 through a porous ceramic plate 970. An outlet manifold 940 removes the ink from the plenum chamber and permits constant circulation. An end-shooter ejection chamber 990 is provided to one side of and is supplied with ink from the fluid chamber. A cover 992 may be used to close both the top of the ejection chamber and the top of the fluid chamber. Any of the above pressure control mechanisms may be used to control the pressure within the fluid chamber.

Figure 10:
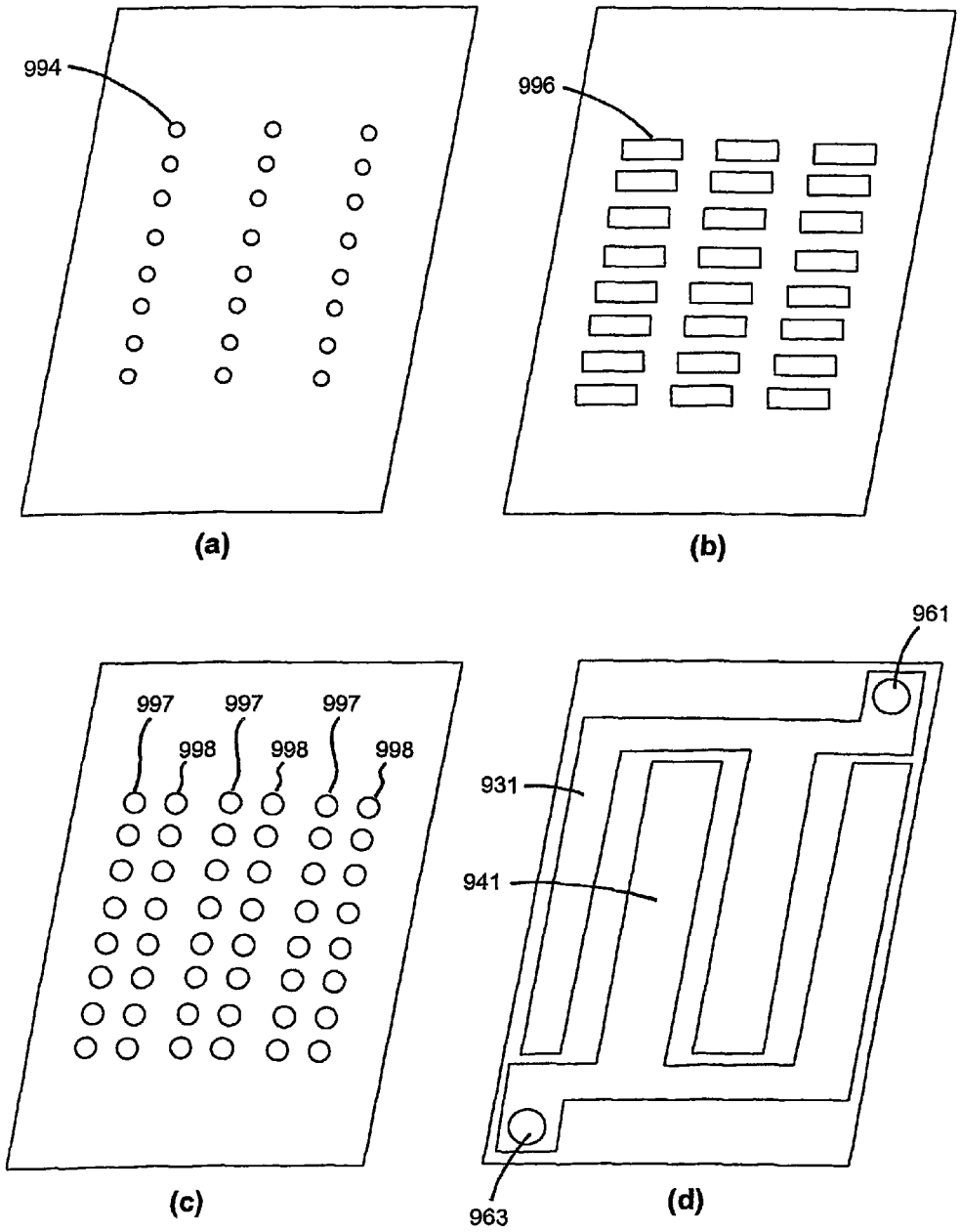
FIG. 10(*a*) to (*g*) depict a plurality of layers which when laminated form a print head according to the present invention.
Figure 10:
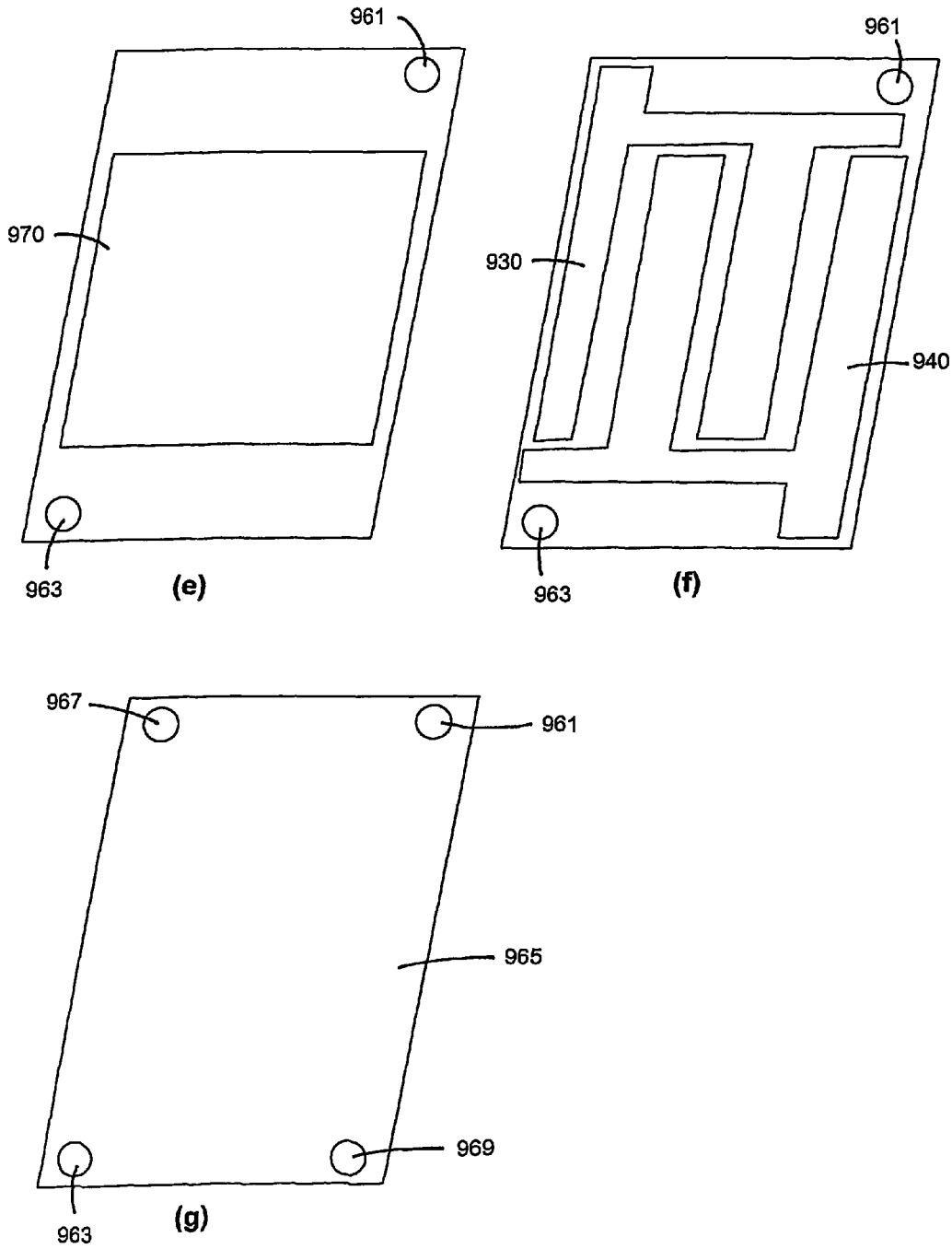

As depicted in FIG. 10, the structure may be formed from a plurality of modules, each module being formed as a laminated stack of plates (a) to (g). Each module has a number of nozzles 994 arranged in an array in a first plate (a). The nozzles 994 communicate with a respective pressure chamber 996 formed within a second plate (b). A number of ports 997, 998 in a plate (c) communicate between the pressure chambers 996 and respective inlet and outlet plenum chambers 931, 941 defined in interdigitated form in plate (d).

Connectors 961,963 are provided to each of the inlet and outlet plenum chamber 931,941 which communicate with the exterior pressure controller. A porous barrier 970 in plate (e) is laminated between the plate (d) that forms the plenum chambers and a further plate (f) that forms the interdigitated inlet and outlet manifolds 930, 940.

A cover plate 965 with four ports 961, 963, 967, 969 closes the manifolds. The plates are preferably formed of a material that has a coefficient of thermal expansion close to that of PZT, for example Nilo 42.

Figure 11:
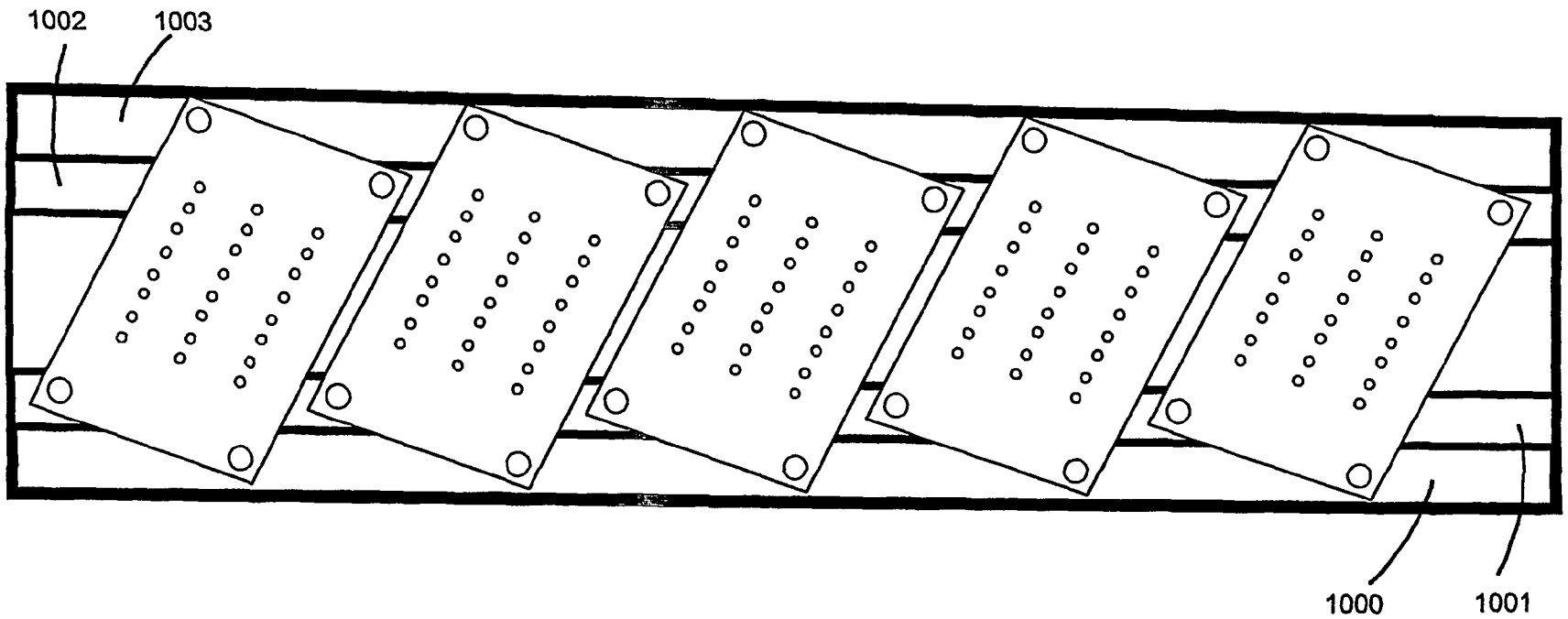
FIG. 11 depicts a plurality of the modules of FIG. 10 mounted to an ink supply support.

The modules may be used as they are or mounted to an ink supply support. The support shown in FIG. 11 comprises four conduits 1000, 1001, 1002, 1003 which communicate with the inlet manifold, inlet plenum chamber, outlet plenum chamber and outlet manifold respectively. The modules are preferably removably mounted to the support as depicted in FIG. 11.

This invention has been described by way of example only and a wide variety of modifications are possible without departing form the scope of the invention.

Thus, the described porous material is only one example of a material or a structure that provides a high pressure drop whilst allowing fluid to pass, with the measurable pressure difference over the material or structure being substantially greater (at least ten and preferably one hundred times) than the pressure drop through the material or structure. Sintered ceramic or metal, woven or meshed fibre or etched, cut or electroformed structures such as chemically etched foil are just examples of porous material. The suggested optional variation in porosity of the porous element along the length of a manifold can also be used to compensate for gravitational effects if the length of the manifold is not horizontal.

The described Wheatstone bridge arrangement for controlling pressure is useful but is not essential. If this arrangement is employed, the described reservoir open to the atmosphere and controllable in height can be replaced by a controllable pressure source.

Each feature disclosed in this specification (which term includes the claims) and/or shown in the drawings may be incorporated in the invention independent of or in combination with other disclosed and/or illustrated features.

The invention claimed is:

1. Droplet deposition apparatus comprising an array of ejection chambers spaced in an array direction, each communicating with a droplet ejection orifice; at least one plenum chamber extending in the array direction and communicating with each of the ejection chambers; and an inlet manifold having a length extending in the array direction and communicating with the plenum chamber through an element providing a resistance to a fluid so as to cause a drop in the pressure of fluid traveling across said element; there being, in use, a flow of fluid from the inlet manifold through the plenum chamber to the ejection chambers, there being a substantial net flow in the array direction in the inlet manifold, wherein the drop in fluid pressure across said element is greater than the total fluid pressure drop along the length of said inlet manifold so as to ensure substantially no net flow in the array direction in the plenum chamber.

2. Apparatus according to claim 1, further comprising an outlet manifold having a length extending in the array direction and communicating with the same or a different plenum chamber through the same or a different element providing a resistance to a fluid so as to cause a further drop in fluid pressure, wherein said further drop in fluid pressure is greater than the total fluid pressure drop along the length of said outlet manifold.

3. Apparatus according to claim 2, there being in use flow of fluid from the inlet manifold through an inlet plenum chamber, through the ejection chambers, through an outlet plenum chamber to the outlet manifold, there being a substantial net flow in the array direction in both the inlet and the outlet manifold, and substantially no net flow in the array direction in either the inlet or the outlet plenum chamber.

4. Apparatus according to claim 3, further comprising pressure control means communicating with the plenum chambers for controlling the pressure at said orifice.

5. Apparatus according to claim 4, wherein the pressure control means comprises a pair of fluid resistances connected in series with the mid point of said resistance being connected with a controllable pressure source.

6. Apparatus according to claim 5, wherein the porosity of said element varies in the array direction.

7. Apparatus according to claim 1, wherein said element is formed of porous material and extends in the array direction.

8. Apparatus according to claim 1, wherein said element providing a resistance to a fluid extends substantially the length of said array of ejection chambers.

* * * * *